US008748766B2

(12) United States Patent
Han

(10) Patent No.: US 8,748,766 B2
(45) Date of Patent: Jun. 10, 2014

(54) BUTTON WITH WATER AND DUST PROOF STRUCTURE

(75) Inventor: Ping Han, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 59 days.

(21) Appl. No.: 13/340,716

(22) Filed: Dec. 30, 2011

(65) Prior Publication Data

US 2013/0161165 A1 Jun. 27, 2013

(30) Foreign Application Priority Data

Dec. 26, 2011 (CN) ..... 2011 1 0440374

(51) Int. Cl.
*H01H 13/06* (2006.01)
*H01H 13/14* (2006.01)
*H01H 13/50* (2006.01)

(52) U.S. Cl.
CPC ..... *H01H 13/06* (2013.01); *H01H 13/14* (2013.01); *H01H 13/50* (2013.01)
USPC ..... 200/302.2; 200/302.1

(58) Field of Classification Search
USPC ..... 200/302.2, 302.1
See application file for complete search history.

(56) References Cited

U.S. PATENT DOCUMENTS

| | | | | |
|---|---|---|---|---|
| 3,940,585 | A * | 2/1976 | Schaad | 200/530 |
| 4,877,930 | A * | 10/1989 | Fukuma | 200/302.2 |
| 6,626,473 | B1 * | 9/2003 | Klein et al. | 292/347 |
| 7,282,657 | B2 * | 10/2007 | Wimmer et al. | 200/302.2 |
| 7,420,136 | B2 * | 9/2008 | Goetzl et al. | 200/341 |
| 2011/0005908 | A1 * | 1/2011 | Lin et al. | 200/302.2 |

* cited by examiner

*Primary Examiner* — Kyung Lee
(74) *Attorney, Agent, or Firm* — Novak Druce Connolly Bove + Quigg LLP

(57) ABSTRACT

An electronic device includes a housing defining a hole and a button structure. The button structure includes a button cap passing through the hole and an elastic member. The elastic member includes a first connection part, a second connection part, and a body. The first connection part and the second connection part are connected via the body, the first connection part is connected to the housing, and the second connection part is connected to the button cap.

16 Claims, 6 Drawing Sheets

BUTTON WITH WATER AND DUST PROOF STRUCTURE

BACKGROUND

1. Technical Field

The present disclosure relates to a button structure and, particularly, to a button with a water and dust proof structure.

2. Description of Related Art

Gaps often exist between button caps and a printed circuit board (PCB), thus results in that dust and water easily getting into the PCB, which may cause damage to the PCB. A cover made of rubber can be added to cover the button caps for water and dust proofing, but the cover normally has an unpleasant appearance and may cause malfunction of the button

BRIEF DESCRIPTION OF THE DRAWINGS

The components of the drawings are not necessarily drawn to scale, the emphasis instead being placed upon clearly illustrating the principles of the present disclosure. Moreover, in the drawings, like reference numerals designate corresponding parts throughout several views.

DETAILED DESCRIPTION

Figure 1:
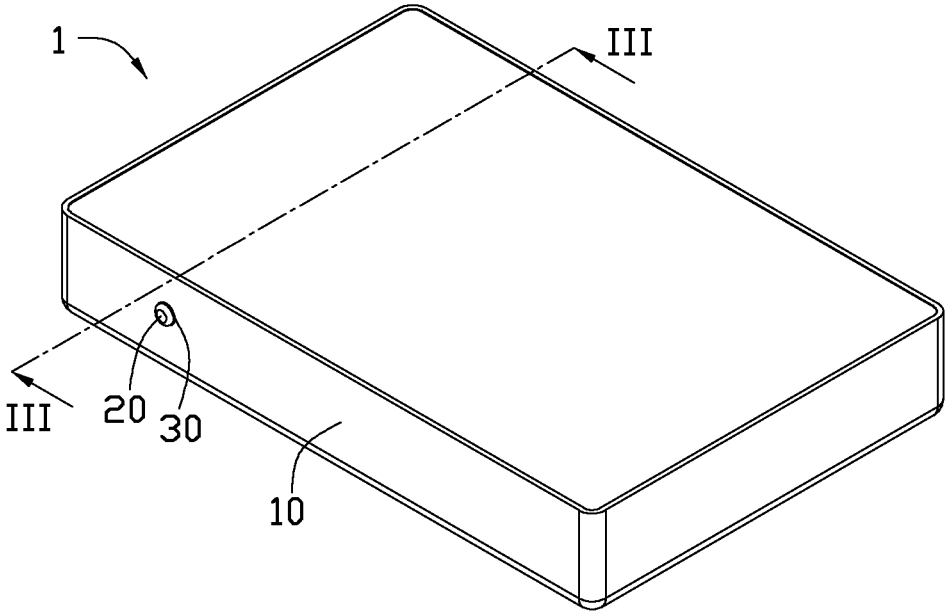
FIG. 1 is an isometric view of an electronic device with a button structure in accordance with an exemplary embodiment.
Figure 2:
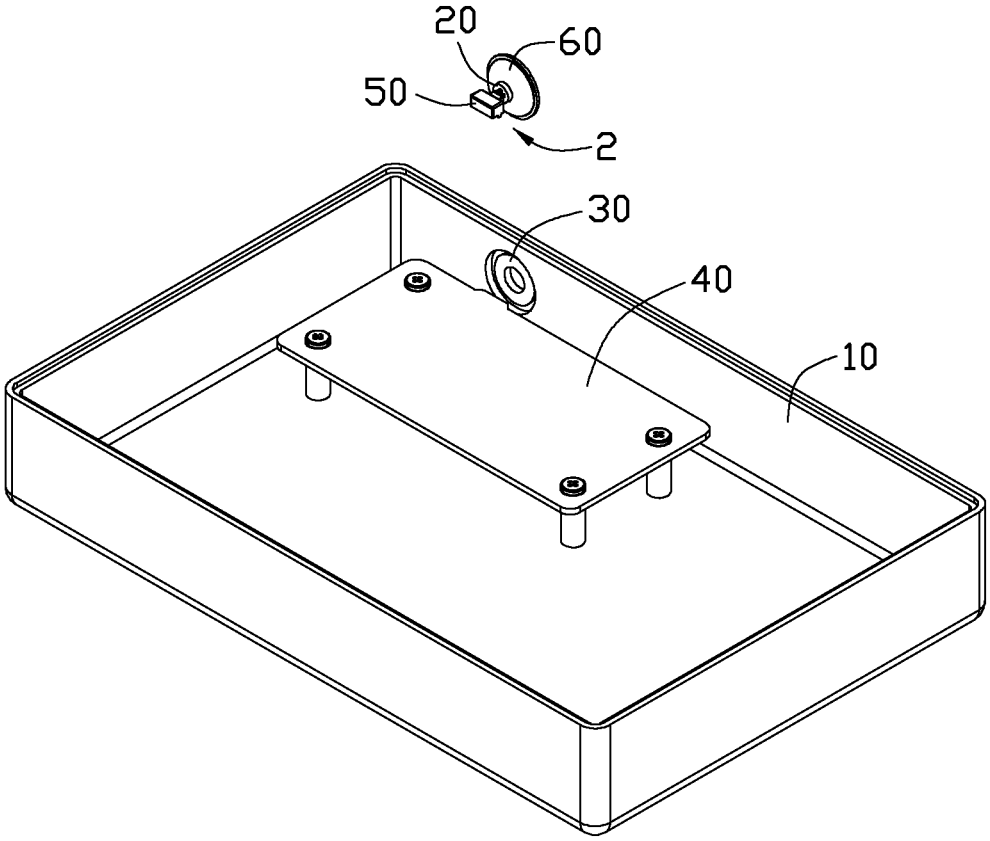
FIG. 2 is an isometric view of the button structure, separated from the electronic device of FIG. 1.
Figure 3:
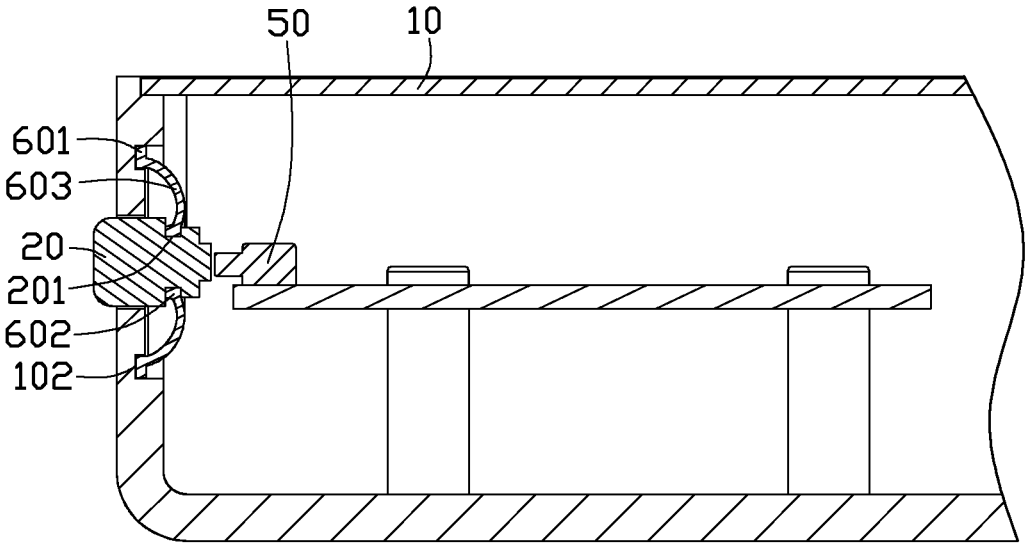
FIG. 3 is a cross-sectional view taken along line III-III of FIG. 1.

FIGS. 1-3, show an electronic device 1 including a button structure 2. The button structure 2 includes a button cap 20, a button switch 50, and an elastic member 60. The button switch 50 is connected to a PCB 40. The button cap 20 passes through a hole 30 defined in a housing 10 of the electronic device 1. The button cap 20 is pressed to move in the hole 30 to trigger the button switch 50.

Figure 4:
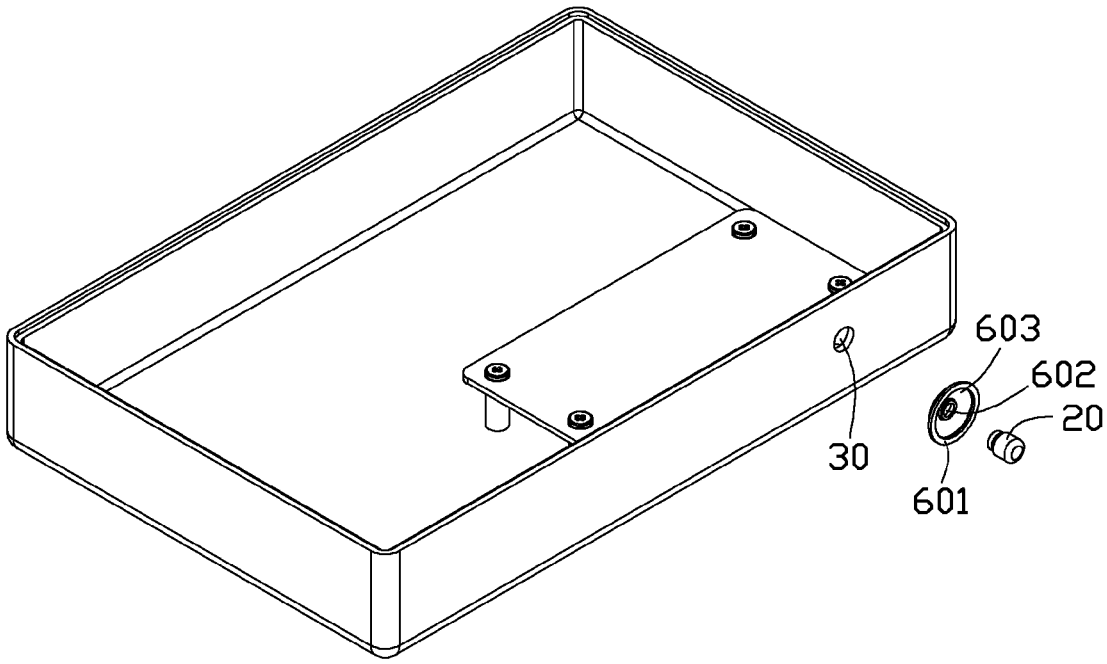
FIG. 4 is an explored view of the electronic device of FIG. 1.

FIG. 4, shows the elastic member 60 including a first connection part 601, a second connection part 602, and a body 603. The first connection part 601 and the second connection part 602 are connected via the body 603. The first connection part 601 and the second connection part 602 are both ring-shaped. The body 603 is bowl-shaped. The first connection part 601 is larger than the second connection part 602.

Figure 5:
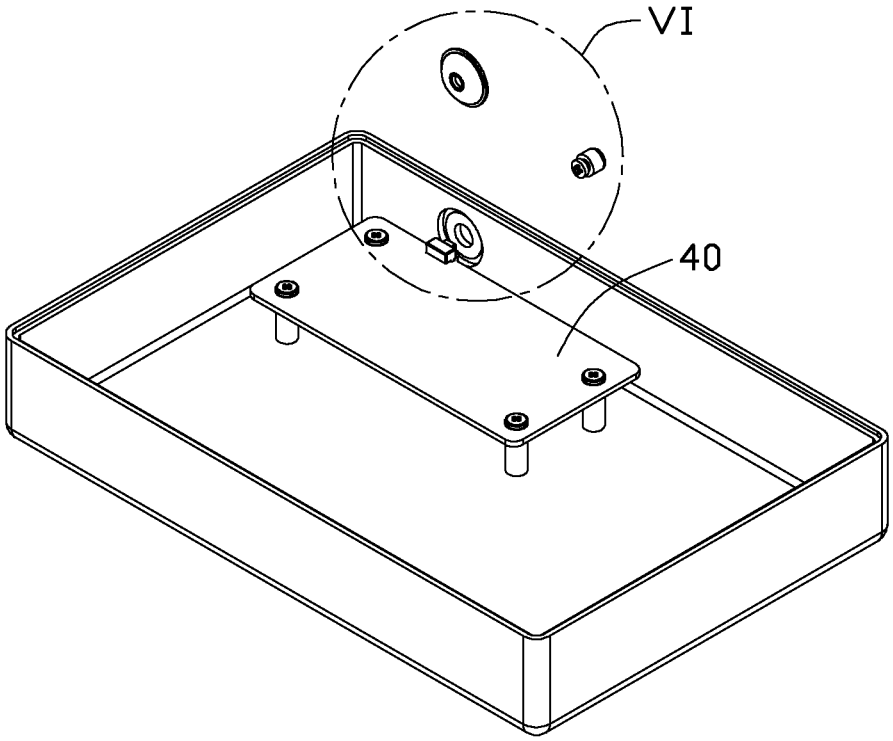
FIG. 5 is an explored view of the electronic device of FIG. 1 viewed in another perspective.
Figure 6:
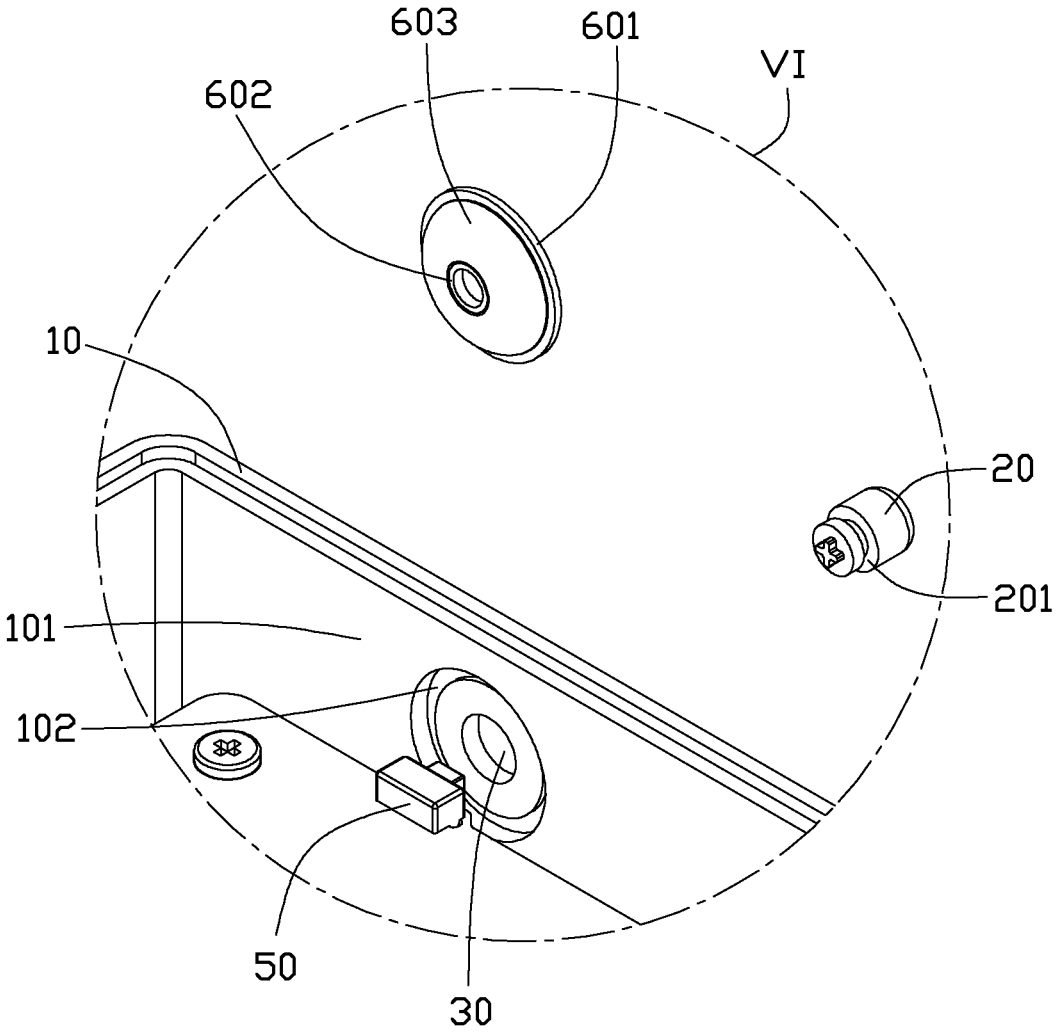
FIG. 6 is an enlarged view of circled portion VI in FIG. 5.

FIGS. 5-6, shows the housing 10 includes a sidewall 101 where the hole 30 is defined, the sidewall 101 defines a first slot 102 surrounding the hole 30. The first slot 102 mates with the first connection part 601. In the embodiment, the first slot 102 is also ring-shaped. The first connection part 601 is placed into the first slot 102 to connect the elastic member 60 to the housing 10. The button cap 20 includes a second slot 201, which mates with the second connection part 602. The second connection part 602 is placed into the second slot 201 to connect the elastic member 60 to the button cap 20. Thus, there is no space between the button cap 20 and the PCB 40 as such water and dust proofing is substantially achieved. Furthermore, when the button cap 20 is pressed to actuate the button switch 50, the elastic member 60 is elastically deformed to move with the button cap 20. Thus, the elastic member 60 does not affect the movement of the button cap 20 in the hole 30. When the button cap 20 is released, the elastic member 60 restores the button cap 20 to its original position for switching off the button switch 50.

In the embodiment, the first connection part 601 is interference fit into the first slot 102, and the second connection part 602 is interference fit into the second slot 201.

In the embodiment, the elastic member 60 is made of thermoplastic polyurethanes (TPU).

Although, the present disclosure has been specifically described on the basis of preferred embodiments, the disclosure is not to be construed as being limited thereto. Various changes or modifications may be made to the embodiment without departing from the scope and spirit of the disclosure.

What is claimed is:

1. An electronic device comprising:

a housing defining a hole;

a button switch accommodated in the housing and substantially aligned with the hole; and a button structure comprising:

a button cap passing through the hole; and an elastic member comprising a first connection part, a second connection part, and a body, wherein the first connection part and the second connection part are connected to each other by the body, the first connection part is connected to the housing, and the second connection part is connected to the button cap;

wherein when the button cap is pressed to actuate the button switch, the elastic member is elastically deformed, and when the button cap is released, the elastic member restores the button cap to its original position.

2. The electronic device as described in claim 1, wherein the housing comprises a sidewall where the hole is defined, the sidewall defines a first slot surrounding the hole, the first slot mates with the first connection part, and the first connection part is placed into the first slot to connect the first connection part to the housing.

3. The electronic device as described in claim 2, wherein the first connection part and the first slot are both ring-shaped.

4. The electronic device as described in claim 2, wherein the first connection part is interference fit into the first slot.

5. The electronic device as described in claim 1, wherein the button cap comprised a second slot which mates with the second connection part, the second connection part is placed into the second slot to connect the second connection part to the button cap.

6. The electronic device as described in claim 1, wherein the second connection part is interference fit into the second slot.

7. The electronic device as described in claim 1, wherein the elastic member is made of thermoplastic polyurethanes (TPU).

8. The electronic device as described in claim 1, wherein the body is bowl-shaped.

9. A button structure for actuating a button switch accommodated in a housing, the housing defining a hole, the button structure comprising:

a button cap passing through the hole of the housing; and an elastic member comprising a first connection part, a second connection part, and a body, wherein the first connection part and the second connection part are connected to each other by the body, the first connection part is connected to the housing, and the second connection part is connected to the button cap;

wherein when the button cap is pressed to actuate the button switch, the elastic member is elastically deformed, and when the button cap is released, the elastic member restores the button cap to its original position.

10. The button structure as described in claim 9, wherein the first connection part is placed into a first slot defined in a sidewall of the housing and surrounding the hole to connect the first connection part to the housing.

11. The button structure as described in claim 9, wherein the first connection part is ring-shaped.

12. The button structure as described in claim 10, wherein the first connection part is interference fit into the first slot.

13. The button structure as described in claim 9, wherein the button cap comprised a second slot which mates with the second connection part, the second connection part is placed into the second slot to connect the second connection part to the button cap.

14. The button structure as described in claim 9, wherein the second connection part is interference fit into the second slot.

15. The button structure as described in claim 9, wherein the elastic member is made of thermoplastic polyurethanes (TPU).

16. The electronic device as described in claim 9, wherein the body is bowl-shaped.

* * * * *